US011320244B2

(12) United States Patent
Verjovsky et al.

(10) Patent No.: US 11,320,244 B2
(45) Date of Patent: May 3, 2022

(54) RIFLE WITH LASER AND ILLUMINATOR SYSTEM INTEGRATED INTO RAIL

(71) Applicants: Alex Verjovsky, Raleigh, NC (US); Peter Michael Lesbo, Twin Falls, ID (US)

(72) Inventors: Alex Verjovsky, Raleigh, NC (US); Peter Michael Lesbo, Twin Falls, ID (US)

( * ) Notice: Subject to any disclaimer, the term of this patent is extended or adjusted under 35 U.S.C. 154(b) by 0 days.

(21) Appl. No.: 17/254,388

(22) PCT Filed: Jun. 28, 2019

(86) PCT No.: PCT/US2019/039787
§ 371 (c)(1),
(2) Date: Dec. 21, 2020

(87) PCT Pub. No.: WO2020/009926
PCT Pub. Date: Jan. 9, 2020

(65) Prior Publication Data

US 2021/0270573 A1 Sep. 2, 2021

Related U.S. Application Data

(60) Provisional application No. 62/693,122, filed on Jul. 2, 2018.

(51) Int. Cl.

| | |
|---|---|
| ***F41G 11/00*** | (2006.01) |
| ***F41C 23/16*** | (2006.01) |
| ***F41G 1/36*** | (2006.01) |

(52) U.S. Cl.
CPC ..... *F41G 11/001* (2013.01); *F41C 23/16* (2013.01); *F41G 1/36* (2013.01)

(58) Field of Classification Search
CPC ..... F41G 11/001; F41G 1/36; F41C 23/16
USPC ..... 42/114
See application file for complete search history.

(56) References Cited

U.S. PATENT DOCUMENTS

| | | | | |
|---|---|---|---|---|
| 5,509,226 | A * | 4/1996 | Houde-Walter | F41G 1/35 362/110 |
| 6,808,340 | B2 | 10/2004 | Travez et al. | |
| 7,114,861 | B1 * | 10/2006 | Tung | H01S 5/02255 385/92 |
| 7,293,942 | B2 | 11/2007 | Travez et al. | |
| 7,325,352 | B2 * | 2/2008 | Matthews | F41G 11/003 362/110 |
| 7,421,818 | B2 * | 9/2008 | Houde-Walter | F41G 11/003 42/115 |
| 7,913,461 | B2 | 3/2011 | Travez et al. | |
| 7,930,957 | B2 | 4/2011 | Travez et al. | |
| 8,136,432 | B2 | 3/2012 | Travez et al. | |
| 8,141,288 | B2 | 3/2012 | Dodd et al. | |
| 8,146,282 | B2 | 4/2012 | Cabahug et al. | |
| 8,302,515 | B2 | 11/2012 | Travez et al. | |
| 8,365,642 | B2 | 2/2013 | Travez et al. | |
| 8,397,418 | B2 | 3/2013 | Cabahug et al. | |

(Continued)

OTHER PUBLICATIONS

"International Search Report and Written Opinion for PCT/US2019/039787 dated Sep. 20, 2019, 12 pages."

*Primary Examiner* — Joshua E Freeman
(74) *Attorney, Agent, or Firm* — Myers Bigel, P.A.

(57) ABSTRACT

A rifle includes a barrel; a rail extending along the barrel; and a laser and illuminator system comprising a cartridge that is releasably held in a front portion of the rail.

18 Claims, 12 Drawing Sheets

(56) References Cited

U.S. PATENT DOCUMENTS

| | | | | |
|---|---|---|---|---|
| 8,402,683 | B2 | 3/2013 | Cabahug et al. | |
| 8,438,793 | B2 | 5/2013 | Travez et al. | |
| 8,443,539 | B2 | 5/2013 | Cabahug et al. | |
| 8,448,368 | B2 | 5/2013 | Cabahug et al. | |
| 8,490,313 | B2 | 7/2013 | Frascati et al. | |
| 8,516,731 | B2 | 8/2013 | Cabahug et al. | |
| 8,695,267 | B2 * | 4/2014 | Houde-Walter | F41G 1/36 42/146 |
| 8,776,422 | B2 | 7/2014 | Dodd et al. | |
| 9,062,933 | B1 * | 6/2015 | Allen | F21V 21/34 |
| D752,169 | S * | 3/2016 | Merlino | D22/108 |
| 9,423,213 | B2 * | 8/2016 | Kowalczyk, Jr. | F41G 3/145 |
| 9,488,445 | B2 * | 11/2016 | Houde-Walter | F41G 1/35 |
| 9,835,411 | B2 * | 12/2017 | Larson, Jr. | F41G 1/17 |
| 9,851,083 | B2 * | 12/2017 | Pinilla | F41C 23/16 |
| 10,551,149 | B2 * | 2/2020 | Teetzel | F41C 23/16 |
| 10,557,687 | B2 * | 2/2020 | Teetzel | F41C 27/06 |
| 2009/0122527 | A1 * | 5/2009 | Galli | F41G 1/35 362/110 |
| 2011/0010979 | A1 * | 1/2011 | Houde-Walter | F41C 23/22 42/84 |
| 2015/0247700 | A1 * | 9/2015 | Merlino | F41C 23/16 42/75.01 |
| 2016/0061560 | A1 * | 3/2016 | Saadon | F41C 23/16 42/72 |
| 2017/0038178 | A1 * | 2/2017 | Pinilla | F41C 23/16 |
| 2018/0003462 | A1 * | 1/2018 | Chavez | F41G 1/35 |
| 2018/0156569 | A1 * | 6/2018 | Chavez | F41G 11/003 |

* cited by examiner

RIFLE WITH LASER AND ILLUMINATOR SYSTEM INTEGRATED INTO RAIL

RELATED APPLICATIONS

This application is a 35 U.S.C. § 371 national stage application of PCT International Application No. PCT/US2019/039787, filed Jun. 28, 2019, which application claims priority from U.S. Provisional Application No. 62/693,122, filed Jul. 2, 2018, the disclosure of which is incorporated herein in its entirety.

BACKGROUND

The introduction of the Picatinny rail in 1995 launched a revolution in the arms industry. Until then, Special Forces relied on improvisation to attach light and sights to their arms.

The Picatinny rail was invented by the Picatinny Arsenal in New Jersey. The purpose of the rail was to standardize a front mount rail along the barrel of an M16 variant known as the M4, and allow for the mounting of optical sights and flashlights to the gun. These optics, lights, and later lasers helped Special Forces cope with operational requirements. The rail also made it possible to safely attach different components to the rifle such as bipods.

SUMMARY

Some embodiments of the present invention are directed to a rifle including a barrel; a rail extending along the barrel; and a laser and illuminator system comprising a cartridge that is releasably held in a front portion of the rail.

A cavity may be defined in the front portion of the rail and may be sized and configured to receive the cartridge in an installed position.

In some embodiments, the cartridge includes a housing. The laser and illuminator system may include: at least one laser (e.g., first and second lasers) in the housing; an illuminator in the housing; and/or a beam steering lens system in the housing, with the lens system positioned between a front of the housing and the first and second lasers and the illuminator.

In some embodiments, a windage adjustment pin extends from the housing and/or an elevation adjustment pin extends from the housing. A distal end of the windage adjustment pin may engage the lens system in response to manipulation of a proximal end of the windage adjustment pin to thereby steer the beams of the first and second lasers and the light of the illuminator in a horizontal direction. A distal end of the elevation adjustment pin may engage the lens system in response to manipulation of a proximal end of the elevation adjustment pin to thereby steer the beams of the first and second lasers and the light of the illuminator in a vertical direction.

In some embodiments, the distal end of the windage adjustment pin engages only the lens system in response to manipulation of the proximal end of the windage adjustment pin. In some embodiments, the distal end of the elevation adjustment pin engages only the lens system in response to manipulation of the proximal end of the elevation adjustment pin.

In some embodiments, a horizontal slot is defined in the front portion of the rail adjacent the cavity and is configured to receive the windage adjustment pin when the cartridge is received in the cavity in the installed position. In some embodiments, a vertical slot is defined in the front portion of the rail adjacent the cavity and is configured to receive the elevation adjustment pin when the cartridge is received in the cavity in the installed position.

The first and second lasers and the illuminator may be circumferentially spaced apart from one another with the illuminator between the first laser and the second laser. The lens system may include a body with first, second, and third spaced apart lenses extending radially from the body. The first lens may be positioned between the first laser and the front of the housing. The second lens may be positioned between the second laser and the front of the housing. The third lens may be positioned between the illuminator and the front of the housing.

In some embodiments, the cartridge comprises a first electrical connection at a rear portion thereof. A second electrical connection may be in the cavity. The first electrical connection and the second electrical connection may engage one another when the cartridge is received in the cavity in the installed position.

In some embodiments, the rifle includes a foregrip that is releasably connectable to a bottom portion of the rail at a plurality of different axial positions. A battery may be held in a chamber of the foregrip. The cartridge, including the first and second lasers and the illuminator, may be electrically connected to and receive power from the battery in the installed position.

In some embodiments, at least one controller is operatively associated with the laser and illuminator system. The at least one controller may be held in the chamber of the foregrip.

In some embodiments, a plurality of user input members are on the foregrip. Each user input member may be configured to control the power and/or intensity of one of the first laser, the second laser, and the illuminator.

In some embodiments, at least one cable extends along or through the rail between the laser and illuminator system and the foregrip and is configured to electrically connect the laser and illuminator system and the battery and/or the controller.

In some embodiments, a door is pivotally connected to the foregrip and configured to be selectively closed and opened to provide access to the chamber including the battery.

In some embodiments, the laser and illuminator system includes: a covert infrared laser; an overt red laser; a covert infrared illuminator; and/or a white flashlight or illuminator.

In some embodiments, a front backup sight is movable between a collapsed position in a groove in the front portion of the rail and an upright position that is about 90 degrees from the collapsed position. In some embodiments, a rear backup sight is movable between a collapsed position in a groove in a rear portion of the rail and an upright position that is about 90 degrees from the collapsed position.

Some other embodiments of the present invention are directed to a method including: providing a rifle comprising a barrel and a rail extending along the barrel; and releasably inserting a laser and illuminator system held in a cartridge into a cavity at a front portion of the rail.

In some embodiments, the laser and illuminator system includes: at least one laser (e.g., first and second lasers) and an illuminator in a housing of the cartridge; a beam steering lens system in the housing of the cartridge; a windage adjustment pin held at least partially in the housing; and/or an elevation adjustment pin held at least partially in the housing. The lens system may include a body, a first lens connected to the body and positioned between the first laser and a front of the housing, a second lens connected to the body and positioned between the second laser and the front of the housing, and a third lens connected to the body and positioned between the illuminator and the front of the housing.

In some embodiments, the method includes at least one of: emitting a first laser beam from the first laser through the first lens and a first aperture defined in the front of the housing; emitting a second laser beam from the second laser through the second lens and a second aperture defined in the front of the housing; and emitting light from the illuminator through the third lens and a third aperture defined in the front of the housing.

In some embodiments, the method includes steering the first laser beam, the second laser beam, and/or the light in a horizontal direction responsive to the windage adjustment pin engaging the lens system. In some embodiments, the method includes steering the first laser beam, the second laser beam, and/or the light in a vertical direction responsive to the elevation adjustment pin engaging the lens system.

In some embodiments, steering the first laser beam, the second laser beam, and/or the light in a horizontal direction comprises manipulating a proximal end of the windage pin outside of the housing such that a distal end of the windage pin engages only the lens system. In some embodiments, steering the first laser beam, the second laser beam, and/or the light in a vertical direction comprises manipulating a proximal end of the elevation pin outside of the housing such that a distal end of the elevation pin engages only the lens system.

In some embodiments, the rifle includes a foregrip having a cavity with a battery and controller therein that are electrically connected to the laser and illumination system. The method may further include: selectively mounting the foregrip at one of a plurality of axial locations on a bottom portion of the rail; and opening a door of the foregrip to access the battery and optionally replace the battery.

Some other embodiments of the present invention are directed to a rail assembly including the rail, the laser and illuminator system, and/or the foregrip as described herein.

Some other embodiments of the present invention are directed to a rifle including a barrel, a rail extending along the barrel, and a laser and illuminator system held in a detachable, serviceable cartridge mounted in the front portion of the rail.

In some embodiments, the laser and illuminator system includes: a covert, infrared laser; an overt laser; a covert infrared illuminator; and a white flashlight or white light illuminator. The covert laser and the overt laser are built into a removable, replaceable cartridge that is mounted at the front portion of the rail. Additionally, elevation and windage correction screws may be on either the right or left side of the cartridge. The covert infrared illuminator and the flashlight may be on the left side of the cartridge.

In some embodiments, the rifle includes a foregrip encasing electronics and a battery held inside the foregrip. The foregrip may include at least one controller operatively associated with the laser and illuminator system. At least one controller may be held in the foregrip. At least one cable may extend through the rail between the laser and illuminator system and the foregrip.

DETAILED DESCRIPTION

Figure 1:
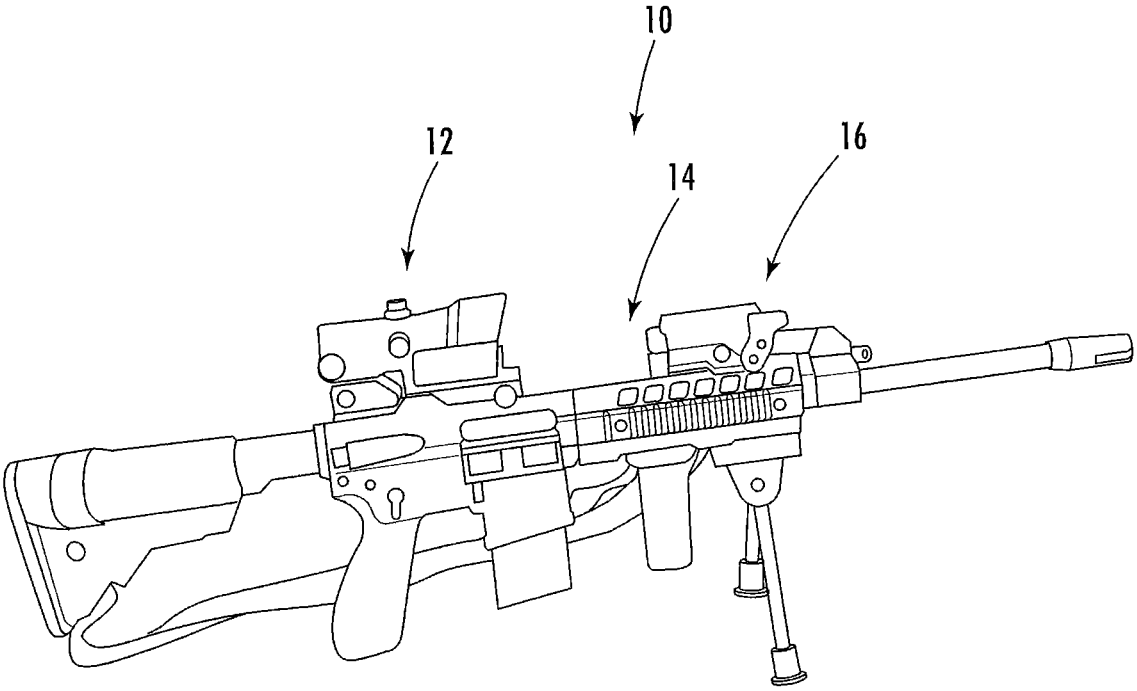
FIG. 1 (PRIOR ART)
FIG. 1 is side perspective view of a prior art Special Forces rifle.

The present invention now will be described more fully hereinafter with reference to the accompanying drawings, in which illustrative embodiments of the invention are shown. In the drawings, the relative sizes of regions or features may be exaggerated for clarity. This invention may, however, be embodied in many different forms and should not be construed as limited to the embodiments set forth herein; rather, these embodiments are provided so that this disclosure will be thorough and complete, and will fully convey the scope of the invention to those skilled in the art.

It will be understood that when an element is referred to as being "coupled" or "connected" to another element, it can be directly coupled or connected to the other element or intervening elements may also be present. In contrast, when an element is referred to as being "directly coupled" or "directly connected" to another element, there are no intervening elements present. Like numbers refer to like elements throughout. As used herein the term "and/or" includes any and all combinations of one or more of the associated listed items.

In addition, spatially relative terms, such as "under," "below," "lower," "over," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly.

Well-known functions or constructions may not be described in detail for brevity and/or clarity.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises," "comprising," "includes" and/or "including," when used in this specification, specify the presence of stated features, integers, steps, operations, elements, and/or components, but do not preclude the presence or addition of one or more other features, integers, steps, operations, elements, components, and/or groups thereof.

It is noted that any one or more aspects or features described with respect to one embodiment may be incorporated in a different embodiment although not specifically described relative thereto. That is, all embodiments and/or features of any embodiment can be combined in any way and/or combination. Applicant reserves the right to change any originally filed claim or file any new claim accordingly, including the right to be able to amend any originally filed claim to depend from and/or incorporate any feature of any other claim although not originally claimed in that manner. These and other objects and/or aspects of the present invention are explained in detail in the specification set forth below.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

FIG. 1 is a side perspective view of a prior art Special Forces rifle 10. A red dot sight 12 may be mounted on the rifle. Various accessories may be mounted to a rail 14. For example, and as illustrated, an overt/covert laser/flashlight accessory 16 may be mounted to the rail 14. The accessory 16 typically includes a self-contained power source (e.g., battery).

Figure 2:
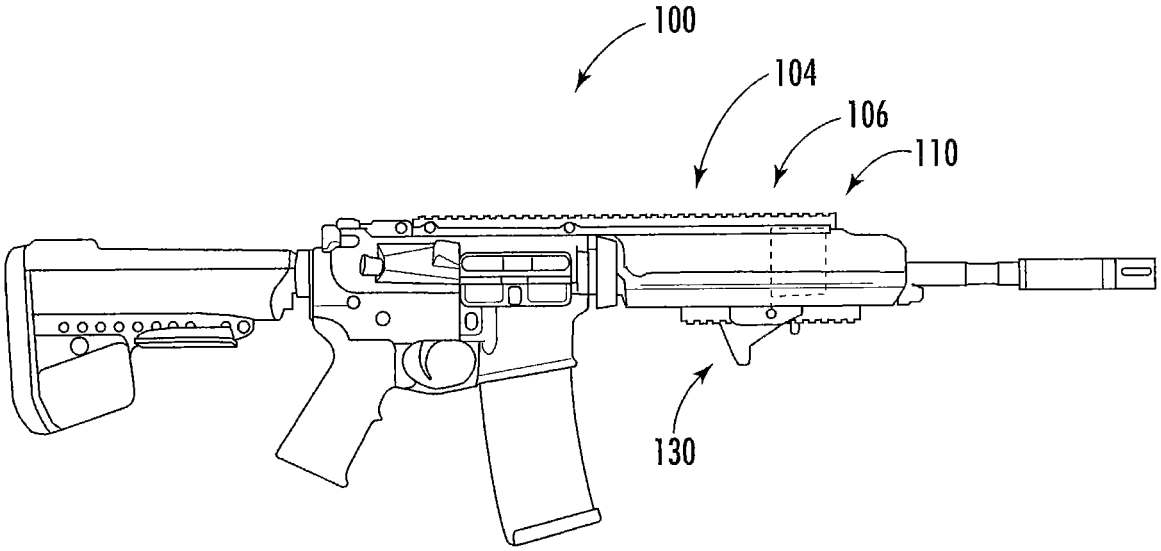
FIG. 2 is a side view of a rifle according to some embodiments of the present invention.

FIG. 2 is a side view of a rifle 100 according to some embodiments of the present invention. A rail 104 extends along a barrel 106 of the rifle 100. The rifle 100 is lighter than the rifle 10 of FIG. 1 primarily due to the integration of lasers and lights into the rail 104.

Figure 4A:
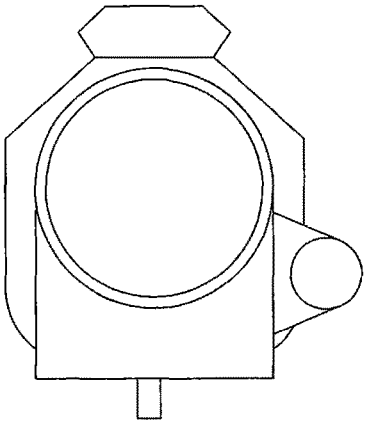
FIG. 4A is an end view of the rail of FIG. 3.
Figure 4B:
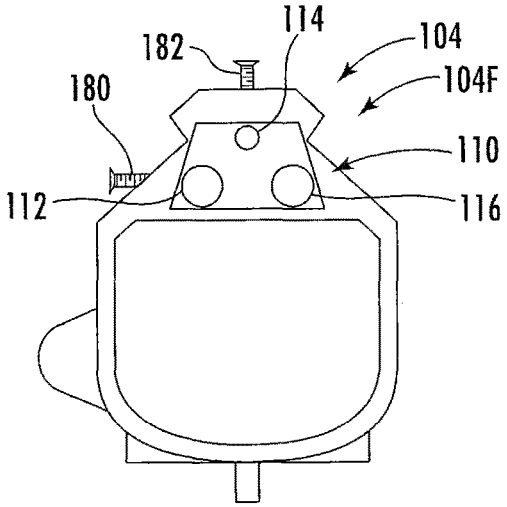
FIG. 4B is an opposite end view of the rail of FIG. 3.

This is illustrated in FIG. 4B. The front or front portion 104F of the rail 104 houses a laser and illuminator system 110. The system 110 may include a set of lasers, an IR illuminator, and/or a flashlight. For example, the system 110 may include a green or covert infrared laser 112 and a red or overt laser 114. The system 110 may further include a covert infrared flashlight or illuminator 116.

Figure 5:
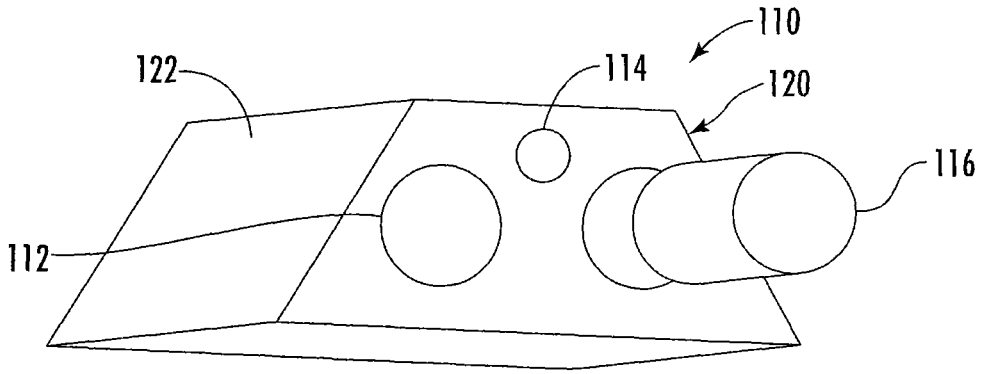
FIG. 5 is a perspective, partially exploded view of a laser and illuminator cartridge according to some embodiments of the present invention.
Figure 6:
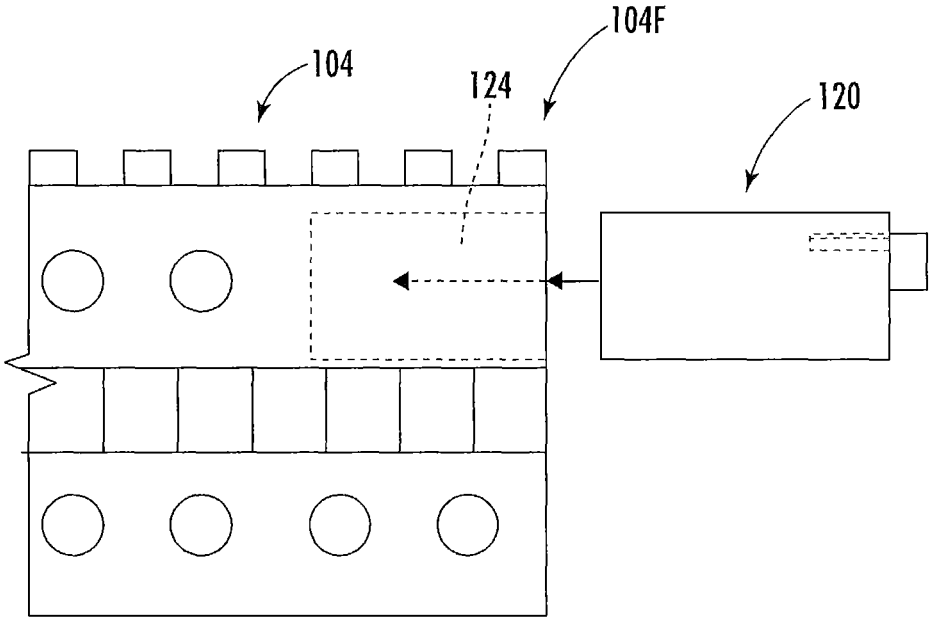
FIG. 6 is a fragmentary side view of the rail of FIG. 3 with the cartridge of FIG. 5 being received in an end thereof.

Referring to FIGS. 5 and 6, the laser and illuminator system 110 may include a cartridge 120. The cartridge 120 may include a body or housing 122 that houses the lights, lasers, and windage and elevation systems. The cartridge 120 can be received in a recess or cavity 124 at the front portion 104F of the rail 104. The cartridge 120 facilitates easy maintenance of the laser and illuminator system 110. For example, if the laser and illuminator system 110 malfunctions, the cartridge 120 can be replaced.

The individual lights and lasers may also be inserted into and removed from the housing 122 of the cartridge 120. For example, referring to FIG. 5, the infrared illuminator 116 may include a module that can be slidably received in the housing 122 of the cartridge 120. Likewise, the infrared laser 112 and the red laser 114 may each include modules that can be slidably received in the housing 122 of the cartridge 120. This further facilitates easy maintenance of the light and illuminator system 110.

Figure 7:
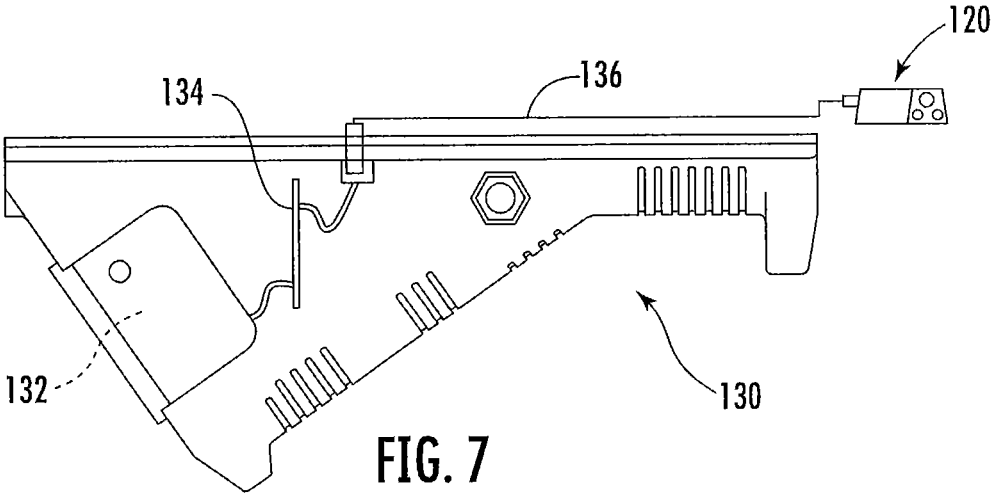
FIG. 7 is a side view of a foregrip configured to connect to a lower portion of the rail of FIG. 3 and provide power to the cartridge of FIG. 5.

Referring to FIG. 7, a power source 132 (e.g., a battery) may be held in a foregrip 130 of the rifle 100. As shown in FIG. 2, the foregrip 130 may be releasably mounted in a plurality of different locations on a bottom portion of the rail 104. In some embodiments, control circuitry for the laser and illuminator system 110 is also in the foregrip 130. For example, the battery 132 may be electrically connected to a driver board 134 (which may be or include a controller), which may in turn be electrically connected to the cartridge 120 via one or more cables 136.

Figure 8:
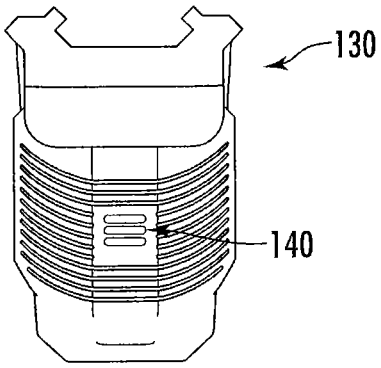
FIG. 8 is an end view of the foregrip of FIG. 7 and illustrates user input members to control the lasers and illuminators in the cartridge of FIG. 5.

Referring to FIG. 8, there may be one or more user input members 140 on a forward portion of the foregrip 130. Each user input member may be, for example, a button and/or a wheel and may be configured to turn on and off a respective laser or light and/or manage the intensity of the laser or light. For example, there may be one user input member 140 for each of the infrared laser 112, the red laser 114, and the infrared illuminator 116.

Figure 9:
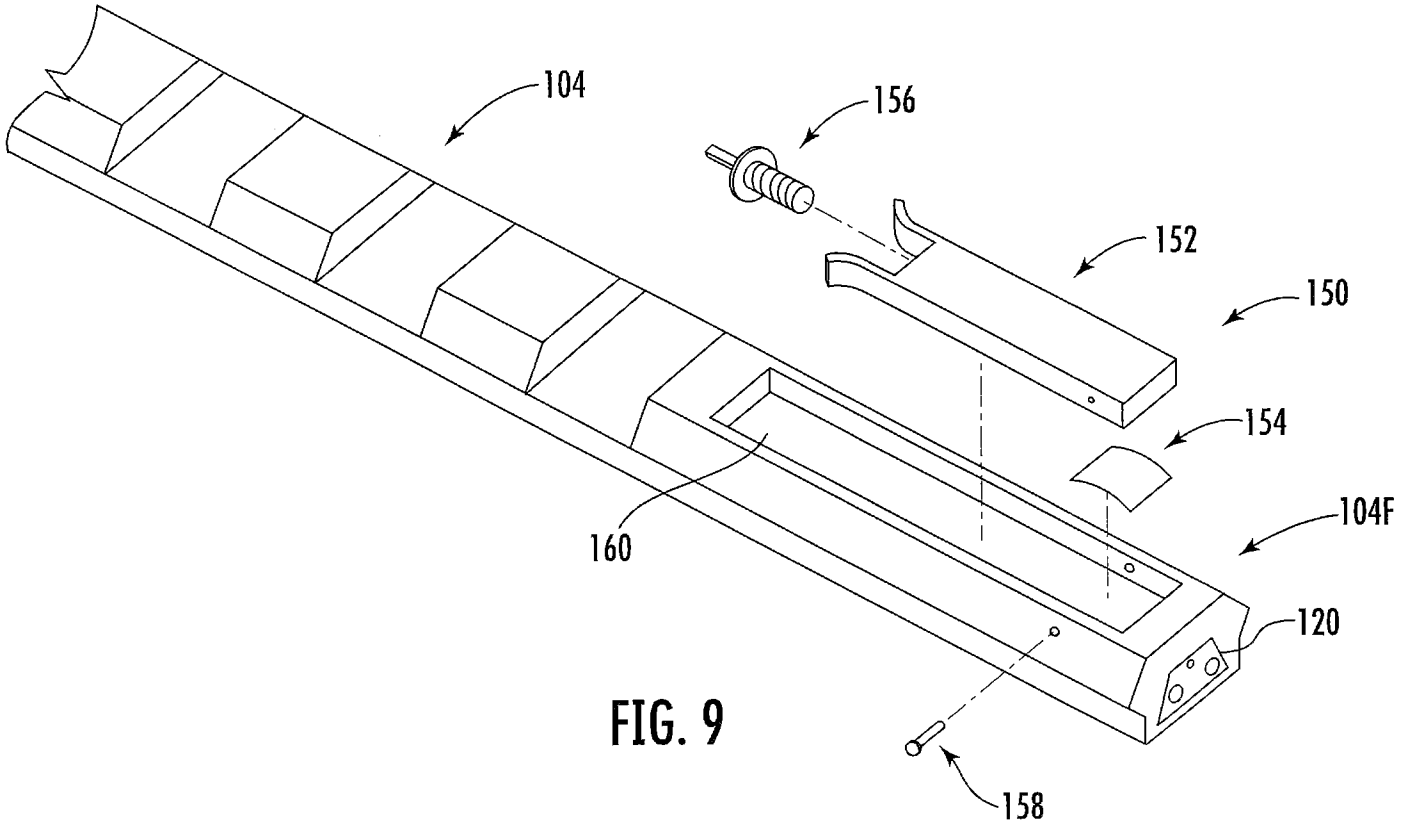
FIG. 9 is an exploded fragmentary perspective view of the rail of FIG. 3 and illustrates a backup sight at a front portion of the rail.

A front backup sight assembly 150 is illustrated in FIG. 9. The assembly 150 may include a front sight 152, a spring 154, a sight retention post 156, and a pivot pin 158. The front sight 152 may be received in a recess or a groove 160 defined in the front portion 104F of the rail 104. The spring 154 may be a flat spring and may bias the front sight 152 toward an upright position (see FIG. 3). The pivot pin 158 may couple the front sight 152 to the rail 104 and allow the front sight to pivot between the upright position (see FIG. 3) and a collapsed position (e.g., with the front sight 152 held flat in the recess 160 when not in use).

The retention post 156 may retain the front sight 152 in the collapsed position.

Figure 3:
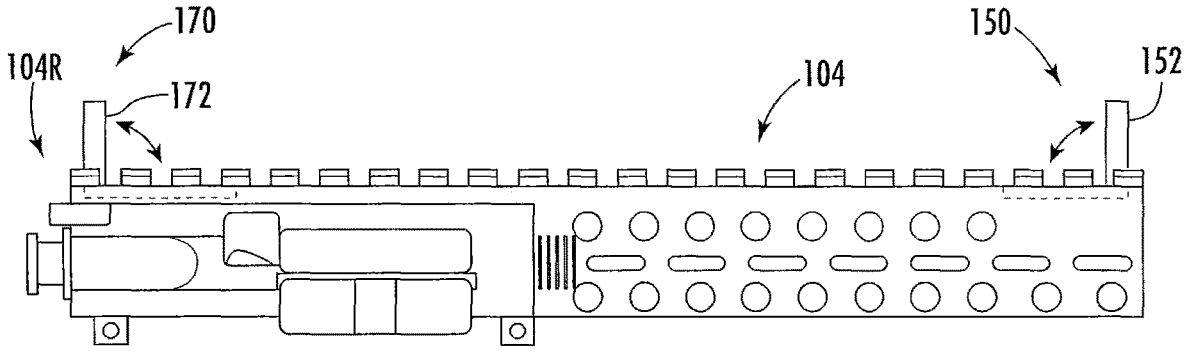
FIG. 3 is a side view of a rail of the rifle of FIG. 2.

Referring to FIG. 3, a rear backup sight assembly 170 may be positioned at a rear portion 104R of the rail 104 and may be substantially the same as the front backup sight assembly 150. For example, the rear backup sight assembly 170 may include a rear sight 172 that is pivotable between an upright position and a collapsed position as shown by the arrow.

The front backup sight 152 and/or the rear backup sight 172 may be used if the laser and illuminator system 110 malfunctions or based on user preference. Referring to FIG. 4B, a windage screw 180 and an elevation screw 182 may be at either or both of the front portion 104F and the rear portion 104R of the rail 104.

Figure 10:
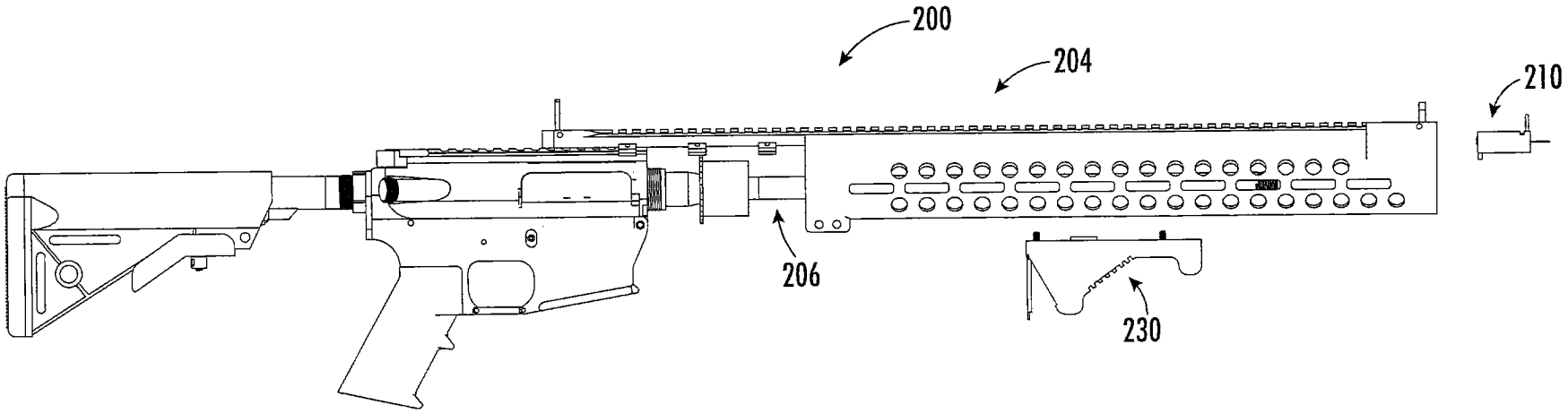
FIG. 10 is a side view of a rifle according to some embodiments of the present invention.

FIG. 10 is a side view of a rifle 200 according to some embodiments of the present invention. A rail 204 extends along a barrel 206 of the rifle 200. The rifle 200 is lighter than the rifle 10 of FIG. 1 primarily due to the integration of lasers and lights into the rail 204.

Figure 11A:
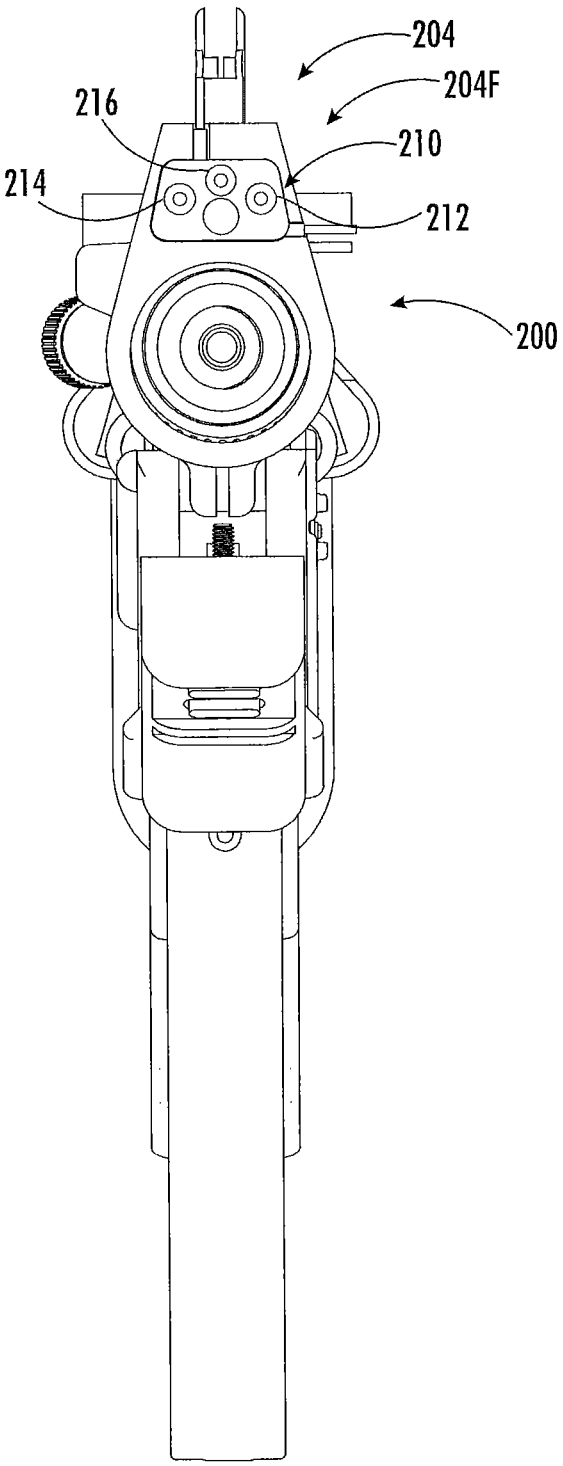
FIG. 11A is a front end view of the rifle of FIG. 10 with a laser and illuminator cartridge installed.

This is illustrated in FIGS. 10 and 11A. The front or front portion 204F of the rail 204 houses a laser and illuminator system 210. The system 210 may include a set of lasers, an IR illuminator, and/or a flashlight. For example, the system 210 may include a green or covert infrared laser 212 and a red or overt laser 214. The system 210 may further include a covert infrared flashlight or illuminator 216.

Figure 12:
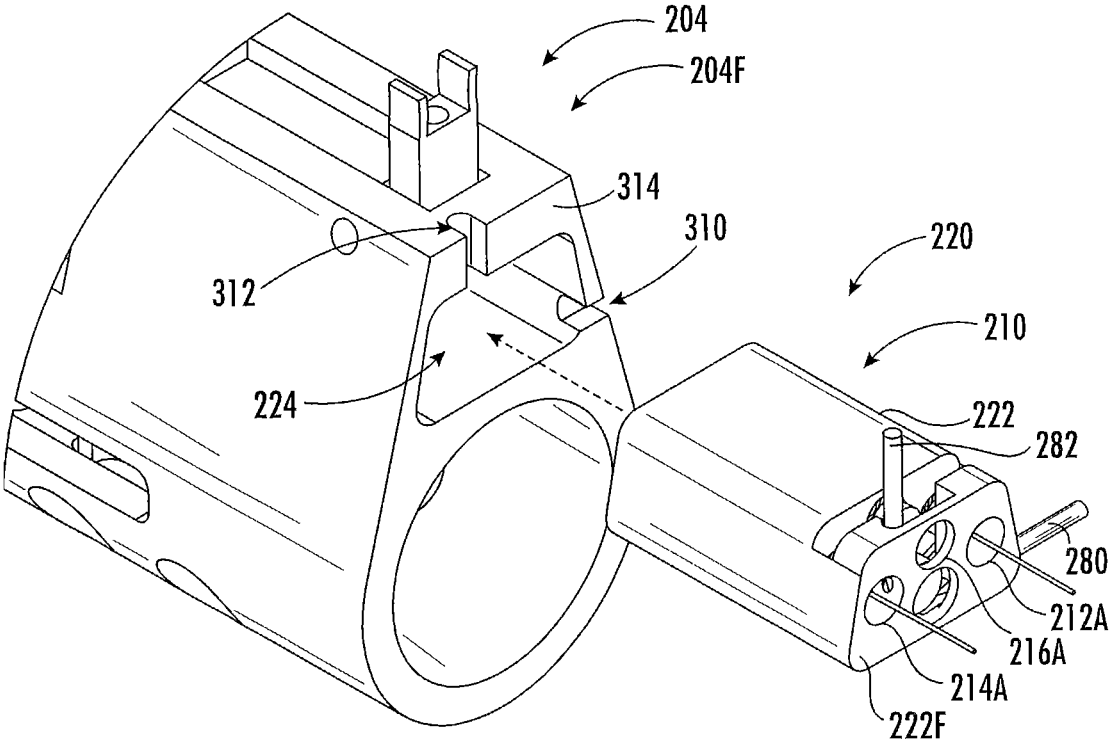
FIG. 12 is a fragmentary perspective view illustrating the laser and illuminator cartridge of FIG. 11A being installed into a cavity at a front portion of a rail of the rifle.
Figure 13:
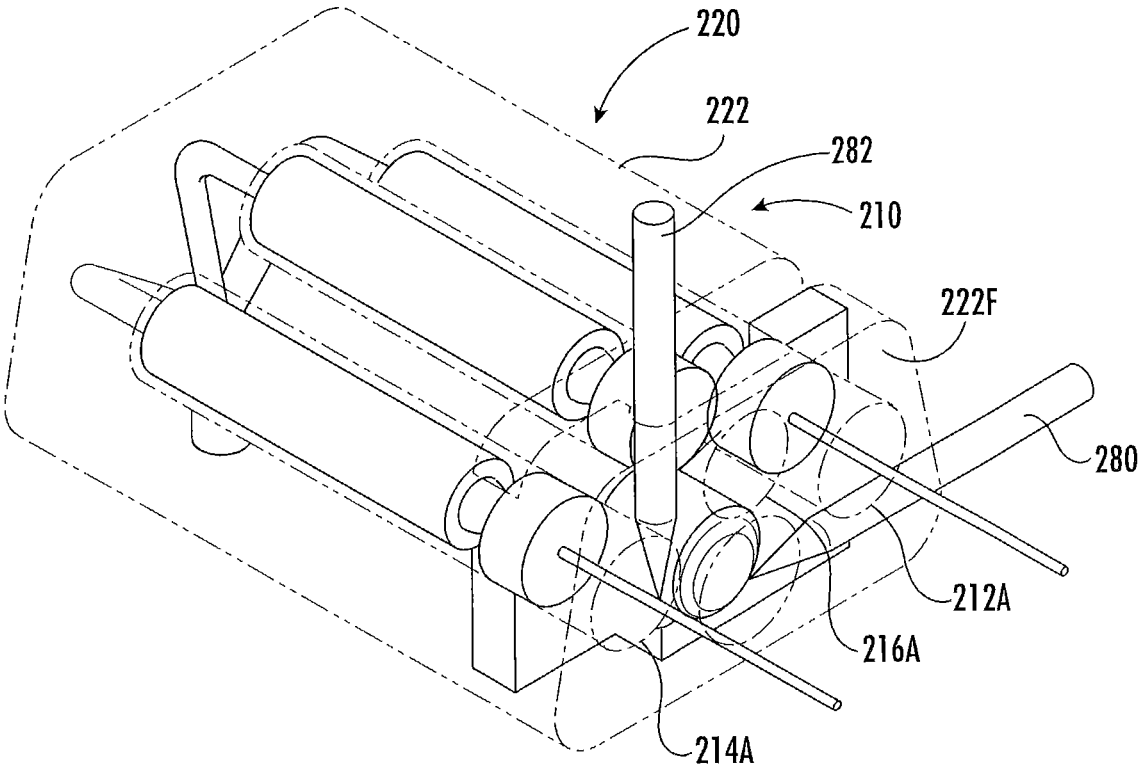
FIG. 13 is a partially transparent perspective view of the laser and illuminator cartridge of FIG. 12.
Figure 14A:
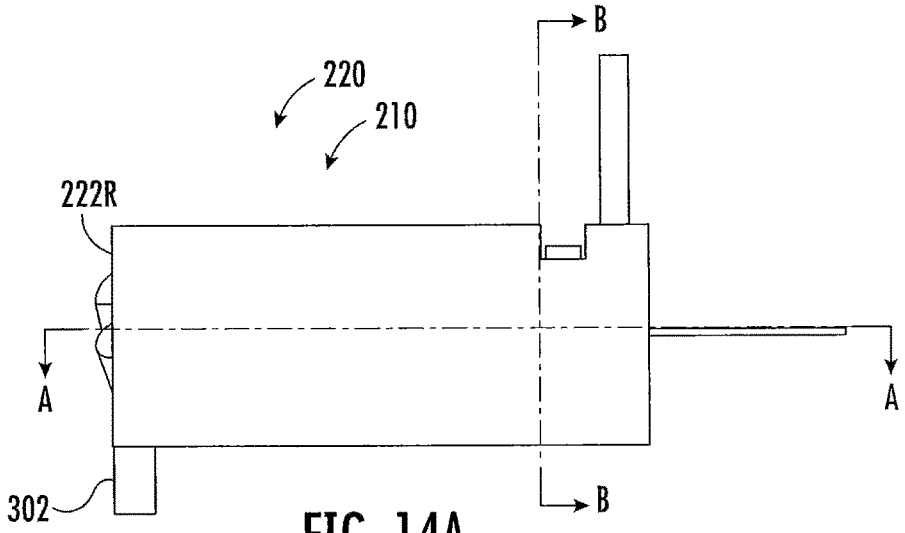
FIG. 14A is a side view of the laser and illuminator cartridge of FIG. 13.
Figure 14B:
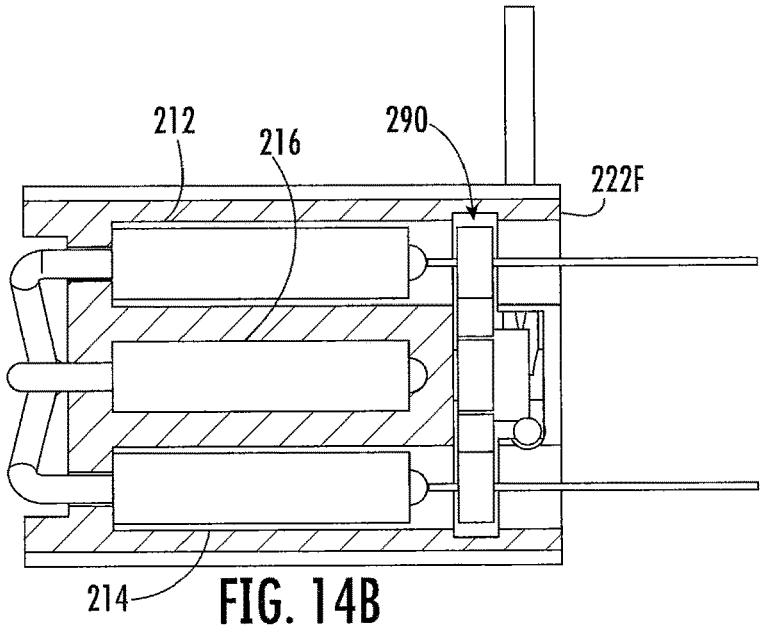
FIG. 14B is a sectional view of the laser and illuminator cartridge taken along line A-A of FIG. 14A.

Referring to FIGS. 12-14, the laser and illuminator system 210 may include a cartridge 220. The cartridge 220 may include a body or housing 222 that houses the lights, lasers, windage and elevation system, and a lens system.

Figure 11B:
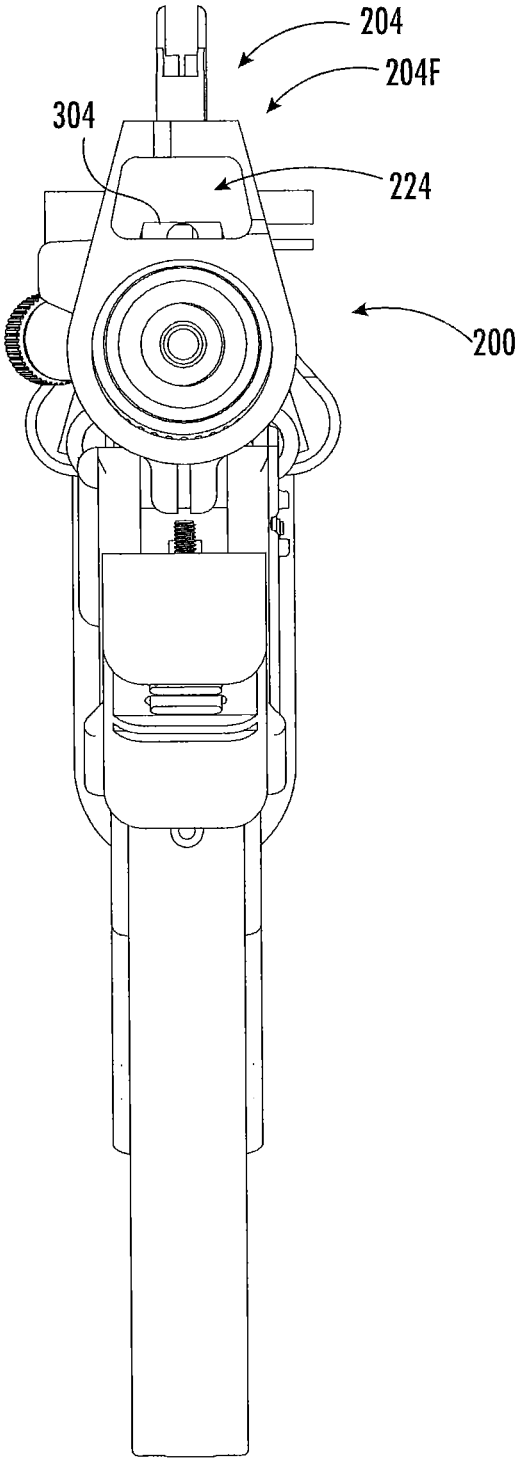
FIG. 11B is a front view of the rifle of FIG. 10 with the laser and illuminator cartridge removed.

Referring to FIGS. 11B and 12, the cartridge 220 can be received in a cavity, recess, or opening 224 at the front portion 204F of the rail 204. The cartridge 220 facilitates easy maintenance of the laser and illuminator system 210. For example, if the laser and illuminator system 210 malfunctions, the cartridge 220 can be replaced.

The individual lights and lasers may also be inserted into and removed from the housing 222 of the cartridge 220. For example, the infrared illuminator 216 may include a module that can be slidably received in the housing 222 of the cartridge 220. Likewise, the infrared laser 212 and the red laser 214 may each include modules that can be slidably received in the housing 222 of the cartridge 220. This further facilitates easy maintenance of the light and illuminator system 210.

Figure 15:
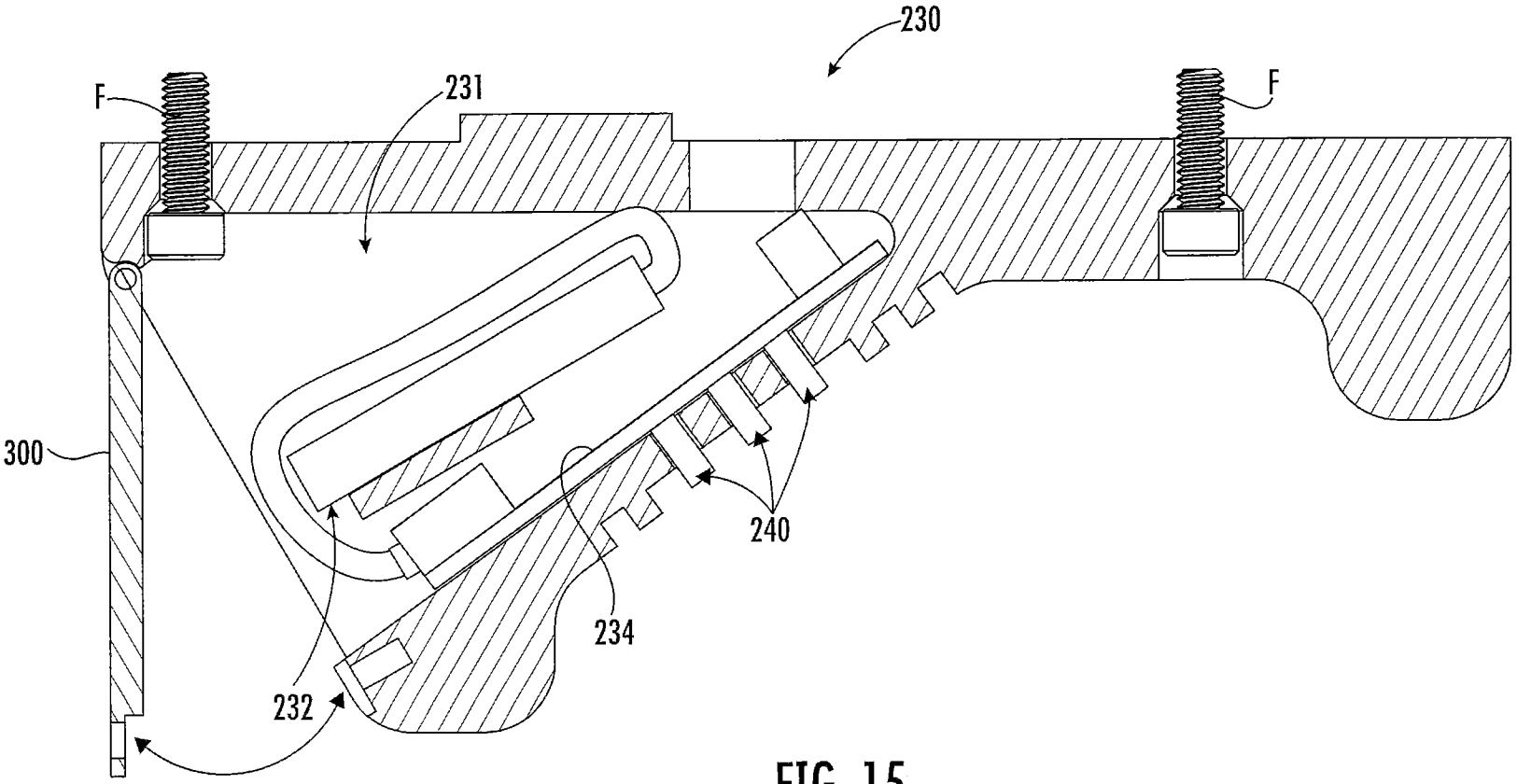
FIG. 15 is a sectional view of a foregrip that is configured to be mounted to a rail of the rifle of FIG. 10.
Figure 16A:
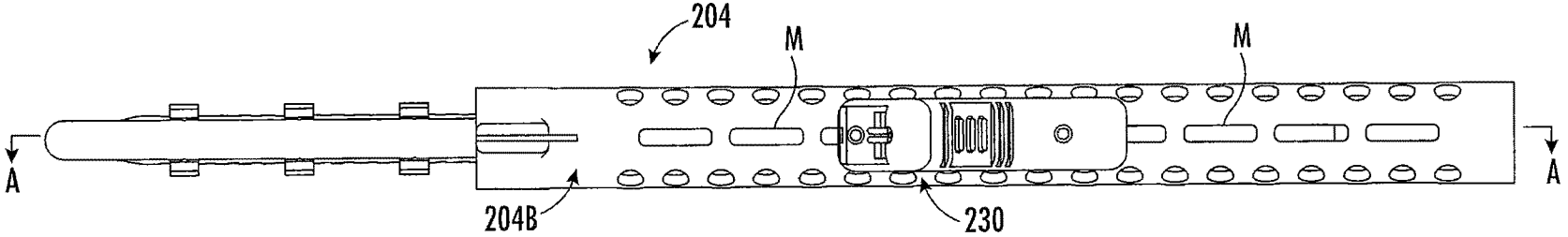
FIG. 16A is a bottom view of a rail of the rifle of FIG. 10 with the foregrip of FIG. 15 mounted thereto.
Figure 16B:
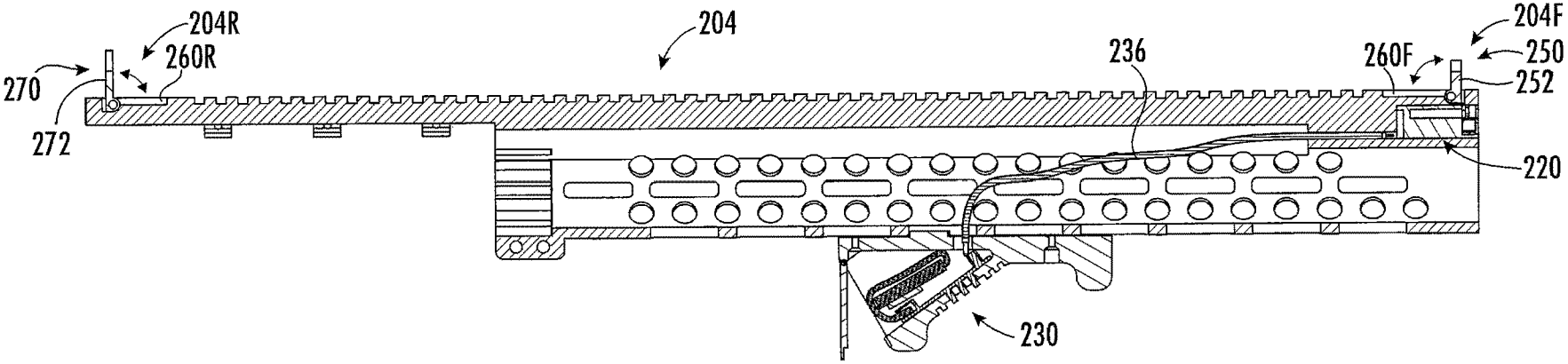
FIG. 16B is a sectional view of the rail and foregrip taken along line A-A of FIG. 16A.

Referring to FIGS. 15 and 16B, a power source 232 (e.g., a battery) may be held in a cavity or chamber 231 of a foregrip 230 of the rifle 200. As shown in FIGS. 10, 15, and 16A, the foregrip 230 may be releasably mounted in a plurality of different (axial) locations on a bottom portion of the rail 204, for example, using fasteners F such as mounting screws that are received in mounting features M such as apertures or holes in the bottom portion 204B of the rail 204. This allows the rifle to be comfortably used by soldiers having a variety of body types (e.g., arm length) and/or preferences.

In some embodiments, control circuitry for the laser and illuminator system 210 is held in the chamber 231 of the foregrip 230. For example, the battery 232 may be electrically connected to a driver board 234 (which may be or include a controller), which may in turn be electrically connected to the cartridge 220 via one or more cables 236.

Still referring to FIG. 15, the foregrip 230 may include a door 300 that is pivotally connected to the foregrip 230 and selectively movable between an open and closed position as shown by the arrow in FIG. 15. In the closed position, the battery door 300 may provide a watertight seal to prevent liquid and other debris from entering the chamber 231 housing the battery 232 and controller 234. In the open position, a user may access the battery 232 and/or the controller 234 for service and/or replacement.

There may be one or more user input members 240 on a forward portion of the foregrip 230. Each user input member may be, for example, a button and/or a wheel and may be configured to turn on and off a respective laser or light and/or manage the intensity of the laser or light. For example, there may be one user input member 240 for each of the infrared laser 212, the red laser 214, and the (infrared) illuminator 216. As the laser(s) and illuminator can be controlled at the foregrip, the soldier does not need to abandon the ready position in order to manage either the illuminator or the laser(s).

Referring to FIG. 16B, the rail 204 may include a front backup sight assembly 250 including a front backup sight 252 and/or a rear backup sight assembly 270 including a rear backup sight 272. The front backup sight assembly 250 and the rear backup sight assembly 270 may be the same or substantially the same as the front backup sight assembly 150 and the rear backup sight assembly 170 described above. Each of the front sight 152 and the rear sight 172 is pivotable between an upright position and a collapsed position as shown by the arrows in FIG. 16B. In the collapsed position, the front sight 152 and the rear sight 172 are received in a front recess 260F defined in the front portion 204F of the rail 204 and a rear recess 260R defined in the rear portion 204R of the rail 204, respectively.

The front backup sight 252 and/or the rear backup sight 272 may be used if the laser and illuminator system 210 malfunctions or based on user preference.

The laser and illuminator system 210 will now be described in more detail with reference to FIGS. 12-14. The cartridge housing 222 includes a front 222F with a plurality of apertures 212A, 214A, 216A defined therein. Laser beams or light from the laser 212, the laser 214, and the illuminator 216 exit through the apertures 212A, 214A, and 216A, respectively.

A beam steering lens assembly 290 is in the cartridge housing 222 between the front 222F of the housing 222 and the laser 212, the laser 214, and the illuminator 216. The lens assembly 290 includes a body 298 with spaced apart beam steering lenses 292, 294, 296 connected thereto and extending radially therefrom. The lens 292 is positioned in front of the laser 212 and configured to steer the beam thereof, the lens 294 is positioned in front of the laser 214 and configured to steer the beam thereof, and the lens 296 is positioned in front of the illuminator 216 and configured to steer the light thereof.

Figure 14C:
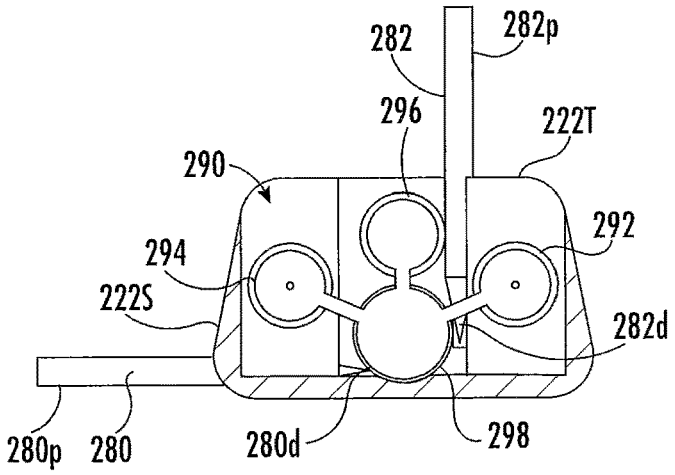
FIG. 14C is a sectional view of the laser and illuminator cartridge taken along line B-B of FIG. 14A.

A windage adjustment mechanism such as a windage pin or screw 280 and an elevation adjustment mechanism such as an elevation pin or screw 282 are received in the housing 222 and extend outside of the housing 222. The windage screw 280 may extend from a side wall 222S of the housing 222 (e.g., one of two opposing side walls 222S of the housing 222) and the elevation screw 282 may extend from a top or upper wall 222T of the housing 222 (FIG. 14C). The windage screw 280 and the elevation screw 282 may engage the lens assembly 290. For example, a distal end 280*d* of the windage screw 280 and a distal end 282*d* of the elevation screw 282 may each engage the body 298 of the lens assembly 290.

A user may manipulate (e.g., rotate) a proximal end 280*p* of the windage screw 280 such that the distal end 280*d* of the windage screw 280 advances and engages and/or urges the lens assembly 290 and steers the beams of the lasers and illuminator in a horizontal direction. Similarly, a user may manipulate (e.g., rotate) a proximal end 282*p* of the elevation screw 282 such that the distal end 282*d* of the elevation screw 282 advances and engages and/or urges the lens assembly 290 and steers the beams of the lasers and illuminator in a vertical direction. The lens assembly 290, such as the body 298, may be spring loaded in the housing 222 so that the lenses 292, 294, 296 are biased toward a default or home position.

The windage screw 280 and the elevation screw 282 may engage the lens assembly 290 while the rail 204, the lasers 212, 214, the illuminator 216, and the housing 222 remain fixed or stationary. This may provide a more controlled and precise steering of the lasers and lights as compared to some known windage and elevation adjustment mechanisms that engage, for example, the rail. In addition, the lasers and illuminator may be heat sinked to the cartridge body, and control of the beam steering by moving the lens assembly rather than the laser, illuminator, and/or cartridge body may increase the longevity of the lasers and illuminator.

Referring to FIGS. 11B and 14A, the cartridge 220 of the laser and illuminator system 210 includes an electrical connection 302 (e.g., at a rear 222R of the body 222) and the rail 204 includes an electrical connection (e.g., in the recess 224). The electrical connection 302 of the laser and illuminator system 210 is configured to engage and connect with the electrical connection 304 of the rail when the cartridge 220 of the laser and illuminator system 210 is inserted into the recess 224 as shown in FIG. 12. The laser and illuminator system 210 is then powered by the battery 232 in the foregrip 230 (FIG. 15).

Referring again to FIG. 12, the windage adjustment pin 280 and the elevation adjustment pin 282 extend outwardly from the body or housing 222 of the cartridge 220. The front portion 204F of the rail 204 has a first (horizontal) slot 310 defined therein configured to receive the windage adjustment pin 280 and a second (horizontal) slot 312 defined therein configured to receive the elevation adjustment pin 280 when the cartridge 220 is in the installed position (FIG. 11A). In this way, the front 222F of the cartridge body may be flush or substantially flush with a front 314 of the rail 204.

Today, a laser/illuminator is a luxury item given only to the better units. The cost is around $1,500 per unit per rifle. If a soldier wants to upgrade his own rifle, the price can be as high as $2,500. An integrated rail as described herein could provide significant savings for the Army and an upgraded weapon throughout the military, as well as resolve the issue of compensating for the sight elevation that is caused by the red dot optic having to be significantly elevated in order to clear the current exterior laser, illuminator unit usually mounted on the top front of the rail and that causes the sight to be higher and thus not aligned with the rail itself. The longer the distance the more compensation the soldier has to make to account for the compensation. Additionally, by incorporating back-up sights, the rail is in effect able to support the soldier even if for some reason (such as the battery losing power), the laser and illuminator would not function, the soldier would still be able to accurately engage targets.

Embodiments of the present invention may provide further advantages over known systems. The lasers and illuminators may be more accurate than for known systems. For example, the lasers and illuminators do not need to be mounted to the rail, which can lead to human error or loosening of the connection over time.

Further, known rifles mount the accessory toward a front portion of the rail. The laser and illuminator accessory, including its heavy battery and housing, results in a front-heavy rifle that tends to shoot low.

Also, the present invention moves the battery and/or the control circuitry to the foregrip. The battery in particular is one of the more bulky components of rail-mounted accessories. The present invention advantageously houses the battery in the foregrip where it can be accessed for replacement. The connections (e.g., cabling) between the battery and the lasers and illuminators are spaced away from the rear of the rifle where recoil could loosen or disconnect the connections.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the teachings and advantages of this invention. Accordingly, all such modifications are intended to be included within the scope of this invention as defined in the claims. The invention is defined by the following claims, with equivalents of the claims to be included therein.

The invention claimed is:

1. A rifle comprising:

a barrel;

a rail extending along the barrel; and a laser and illuminator system comprising a cartridge that is releasably held in a front portion of the rail, wherein the cartridge comprises a housing, and wherein the laser and illuminator system comprises:

first and second lasers in the housing;

an illuminator in the housing; and a beam steering lens system in the housing, the lens system positioned between a front of the housing and the first and second lasers and the illuminator.

2. The rifle of claim 1 wherein a cavity is defined in the front portion of the rail and is sized and configured to receive the cartridge in an installed position.

3. The rifle of claim 2 wherein:

the cartridge comprises a first electrical connection at a rear portion thereof;

a second electrical connection is in the cavity; and the first electrical connection and the second electrical connection engage one another when the cartridge is received in the cavity in the installed position.

4. The rifle of claim 3 further comprising:

a foregrip that is releasably connectable to a bottom portion of the rail at a plurality of different axial positions; and a battery held in a chamber of the foregrip, wherein the cartridge, including the first and second lasers and the illuminator, is electrically connected to and receives power from the battery in the installed position.

5. The rifle of claim 4 further comprising at least one controller operatively associated with the laser and illuminator system, wherein the at least one controller is optionally held in the chamber of the foregrip.

6. The rifle of claim 5 further comprising a plurality of user input members on the foregrip, each user input member configured to control the power and/or intensity of one of the first laser, the second laser, and the illuminator.

7. The rifle of claim 4 further comprising at least one cable extending along or through the rail between the laser and illuminator system and the foregrip and configured to electrically connect the laser and illuminator system and the battery and/or the controller.

8. The rifle of claim 4 further comprising a door pivotally connected to the foregrip and configured to be selectively closed and opened to provide access to the chamber including the battery.

9. The rifle of claim 1 further comprising a windage adjustment pin extending from the housing and an elevation adjustment pin extending from the housing.

10. The rifle of claim 9 wherein:

a distal end of the windage adjustment pin engages the lens system in response to manipulation of a proximal end of the windage adjustment pin to thereby steer the beams of the first and second lasers and the light of the illuminator in a horizontal direction; and a distal end of the elevation adjustment pin engages the lens system in response to manipulation of a proximal end of the elevation adjustment pin to thereby steer the beams of the first and second lasers and the light of the illuminator in a vertical direction.

11. The rifle of claim 10 wherein:

the distal end of the windage adjustment pin engages only the lens system in response to manipulation of the proximal end of the windage adjustment pin; and the distal end of the elevation adjustment pin engages only the lens system in response to manipulation of the proximal end of the elevation adjustment pin.

12. The rifle of claim 9 wherein:

a horizontal slot is defined in the front portion of the rail adjacent the cavity and is configured to receive the windage adjustment pin when the cartridge is received in the cavity in the installed position; and a vertical slot is defined in the front portion of the rail adjacent the cavity and is configured to receive the elevation adjustment pin when the cartridge is received in the cavity in the installed position.

13. The rifle of claim 1 wherein:

the first and second lasers and the illuminator are circumferentially spaced apart from one another with the illuminator between the first laser and the second laser;

the lens system comprises a body with first, second, and third spaced apart lenses extending radially from the body;

the first lens is positioned between the first laser and the front of the housing;

the second lens is positioned between the second laser and the front of the housing; and the third lens is positioned between the illuminator and the front of the housing.

14. The rifle of claim 1 wherein the laser and illuminator system comprises:

a covert infrared laser;

an overt red laser;

a covert infrared illuminator; and/or a white flashlight or illuminator.

15. The rifle of claim 1 further comprising:

a front backup sight that is movable between a collapsed position in a groove in the front portion of the rail and an upright position that is about 90 degrees from the collapsed position; and/or a rear backup sight that is movable between a collapsed position in a groove in a rear portion of the rail and an upright position that is about 90 degrees from the collapsed position.

16. A method comprising:

providing a rifle comprising a barrel and a rail extending along the barrel;

releasably inserting a laser and illuminator system held in a cartridge into a cavity at a front portion of the rail, wherein:

the laser and illuminator system comprises:

first and second lasers and an illuminator in a housing of the cartridge;

a beam steering lens system in the housing of the cartridge, the lens system comprising a body, a first lens connected to the body and positioned between the first laser and a front of the housing, a second lens connected to the body and positioned between the second laser and the front of the housing, and a third lens connected to the body and positioned between the illuminator and the front of the housing;

a windage adjustment pin held at least partially in the housing; and an elevation adjustment pin held at least partially in the housing;

the method further comprises:

at least one of:

emitting a first laser beam from the first laser through the first lens and a first aperture defined in the front of the housing;

emitting a second laser beam from the second laser through the second lens and a second aperture defined in the front of the housing; and emitting light from the illuminator through the third lens and a third aperture defined in the front of the housing;

steering the first laser beam, the second laser beam, and/or the light in a horizontal direction responsive to the windage adjustment pin engaging the lens system; and steering the first laser beam, the second laser beam, and/or the light in a vertical direction responsive to the elevation adjustment pin engaging the lens system.

17. The method of claim 16 wherein:

steering the first laser beam, the second laser beam, and/or the light in a horizontal direction comprises manipulating a proximal end of the windage pin outside of the housing such that a distal end of the windage pin engages only the lens system; and steering the first laser beam, the second laser beam, and/or the light in a vertical direction comprises manipulating a proximal end of the elevation pin outside of the housing such that a distal end of the elevation pin engages only the lens system.

18. The method of claim 16 wherein:

the rifle comprises a foregrip having a cavity with a battery and controller therein that are electrically connected to the laser and illumination system;

the method further comprises:

selectively mounting the foregrip at one of a plurality of axial locations on a bottom portion of the rail; and opening a door of the foregrip to access the battery and optionally replace the battery.

* * * * *